US005576720A

United States Patent [19]

Gorenz, Jr. et al.

[11] Patent Number: 5,576,720

[45] Date of Patent: Nov. 19, 1996

[54] ASSEMBLY FOR MOUNTING A RADIO FREQUENCY ANTENNA TO A COMMUNICATION DEVICE

[75] Inventors: Harold J. Gorenz, Jr., Lisle; William R. Groves, Naperville; Charles D. Hood, III, Elmhurst, all of Ill.

[73] Assignee: Motorola, Inc., Schaumburg, Ill.

[21] Appl. No.: 383,393

[22] Filed: Feb. 3, 1995

[51] Int. Cl.[6] ..... H01Q 1/24; H01Q 1/50

[52] U.S. Cl. ..... 343/702; 343/906; 439/916; 439/349

[58] Field of Search ..... 343/702, 906, 343/888; 439/916, 352, 358, 345, 349, 350; H01Q 1/24, 1/50

[56] References Cited

U.S. PATENT DOCUMENTS

| | | | |
|---|---|---|---|
| 2,590,505 | 3/1952 | Carlsen | 439/349 |
| 4,867,698 | 9/1989 | Griffiths | 439/916 |

FOREIGN PATENT DOCUMENTS

| | | | |
|---|---|---|---|
| 549730 | 2/1923 | France | 439/349 |

*Primary Examiner*—Donald T. Hajec
*Assistant Examiner*—Hoanganh Le
*Attorney, Agent, or Firm*—Donna Rogers-Maddox

[57] ABSTRACT

A mounting assembly to attach an radio frequency antenna to a housing of a communication device for removably securing the antenna to the communication device, the assembly includes an antenna and a circular base member extending from the antenna. The assembly allows for the quick and easy detachment of the antenna from the device without the use of tools. The communication device to which the antenna assembly is attached has a generally tubular shaped opening defining a communication device housing having a circular cross-section for removably receiving the circular base member. The housing includes an outside face, an inside face, and a recessed locking slot extending from the outside face towards the inside face. Also included are mating members for connecting a portion of the circular base member to the RF coupling and a non-contiguous locking band coaxially surrounding a portion of the circular base member for providing slidably frictional rotation of the base member within the locking band and configured to axially retain the circular base member within the locking band. The locking band has a radially projecting tongue adapted to engage the recessed locking slot to prevent rotation of the locking band relative to the housing while permitting rotation of the circular base member. The locking band is adapted to resist axial movement of the base member relative to the housing.

16 Claims, 4 Drawing Sheets

ASSEMBLY FOR MOUNTING A RADIO FREQUENCY ANTENNA TO A COMMUNICATION DEVICE

BACKGROUND OF THE INVENTION

Conventional antennas now in use are typically telescopic where the user thereof must axially pull or push the antenna to extend or return it to a non-use position. Such antennas are usually thin, tubular sheet metal members which are subject to damage or breakage, and ultimate replacement.

Non-telescopic antennas are usually fixed in place and are also susceptible to damage. Such antennas are inconvenient and cumbersome to use since they often cannot be moved relative to the communication device to which they are attached. When these antennas require replacement, the equipment typically must be disassembled to gain access to the antenna connector and cable. Replacement may be relatively expensive and time consuming, often requiring servicing by the manufacturer.

Accordingly, a mounting assembly for attaching a radio frequency (RF) antenna to a mounting structure of a communication device that substantially overcomes the above problem is needed. Such a device should allow for continuous rotation of the antenna relative to the equipment to which is attached, and should allow quick and easy testing of the antenna and field replacement of the antenna without use of tools. Additionally, a device is needed which provides a mounting assembly that allows the antenna to snap into the communication device housing without requiring access to the interior of the equipment.

The present invention includes a mounting assembly to attach an RF antenna to a housing of a communication device for removably securing the antenna to the communication device. The invention further includes an antenna, a substantially circular base member extending from the antenna, and a non-contiguous locking band coaxially surrounding a portion of the circular base member for providing slidably frictional rotation of the base member within the locking band. The locking band is configured to axially retain the circular base member within the arc of the locking band.

A mounting structure in the housing defines a generally tubular shaped opening, where the opening has a substantially circular cross-section for removably receiving the substantially circular base member. The housing also includes an outside face, an inside face, and a recessed locking slot extending from the outside face towards the inside face. The locking band has a radially projecting tongue adapted to engage the locking slot to prevent rotation of the locking band relative to the housing while permitting rotation of the circular base member. The locking band is adapted to resist axial displacement of the base member relative to the housing. A coupler mechanism is included which connects a portion of the circular base member to an RF coupling.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Figures 1A, 1B:
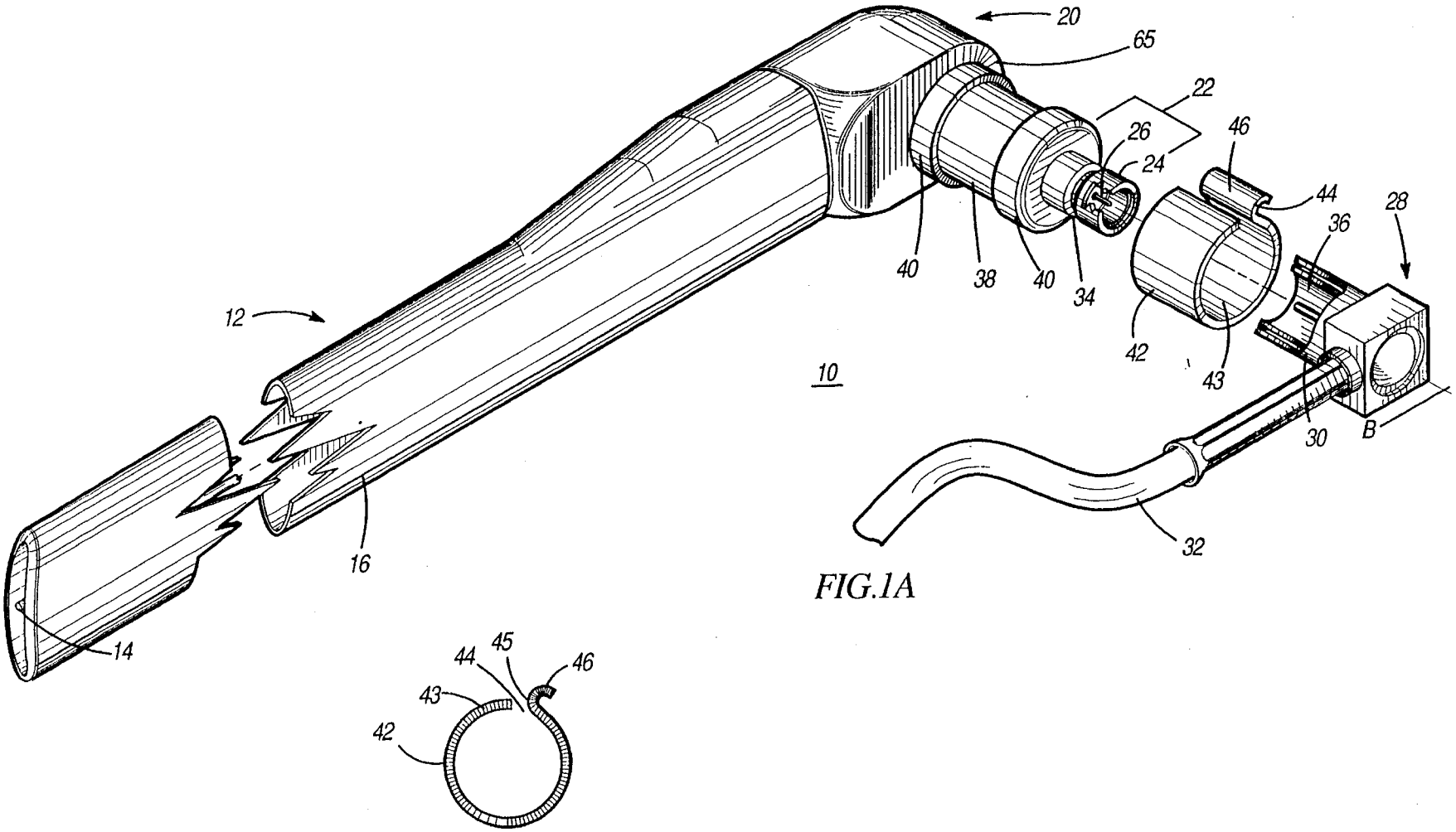
FIG. 1A is an exploded perspective view of a specific embodiment of an antenna, a base member, and a locking band according to the present invention.
FIG. 1B is a cross-sectional view of a specific embodiment of a locking band shown in FIG. 1A taken along line 1—1 of FIG. 1A.
Figure 2:
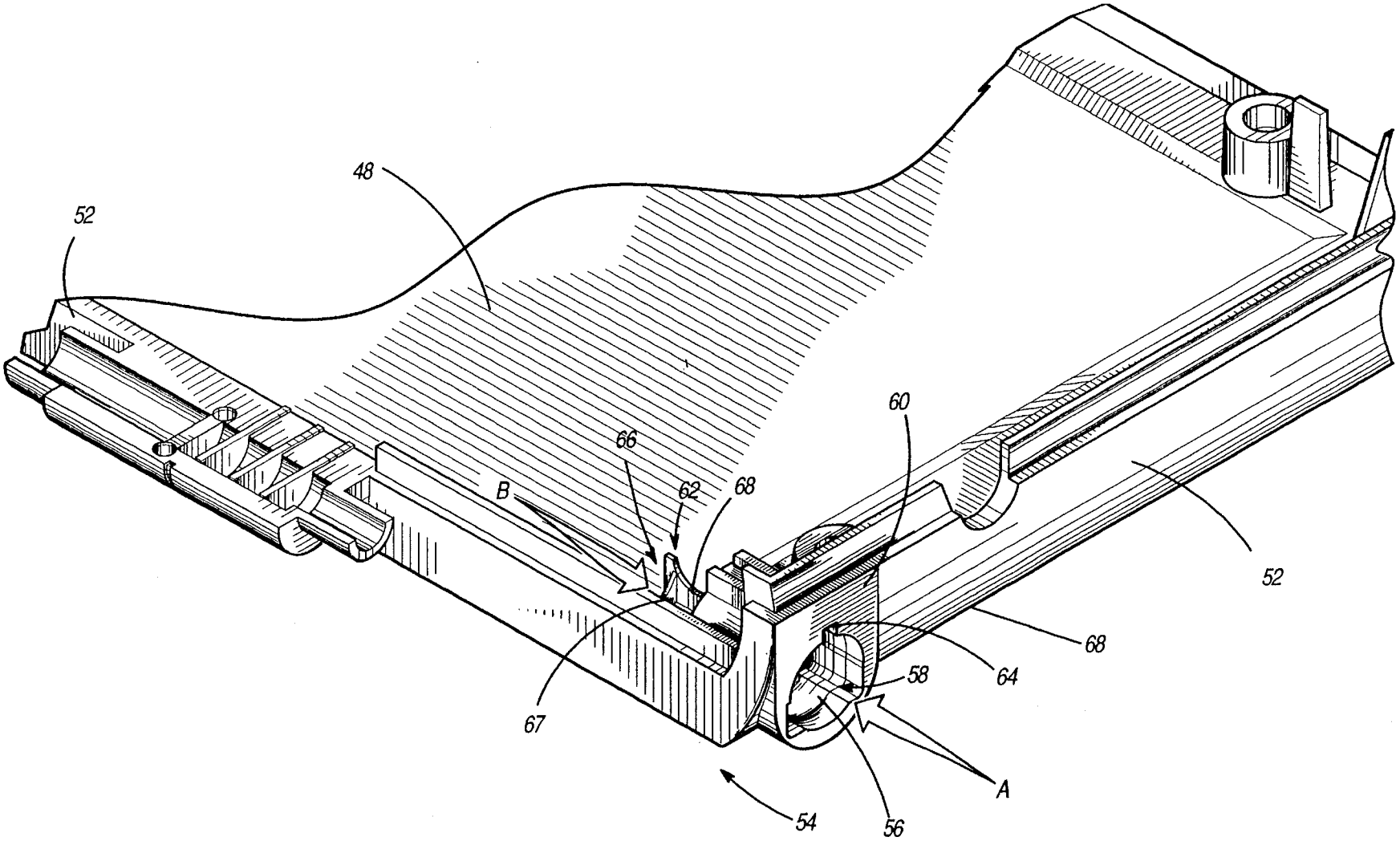
FIG. 2 is a perspective view of a specific embodiment of an equipment cover and a housing according to the present invention.

Referring now to FIG. 1A, one embodiment of a mounting assembly for attaching an RF antenna to a housing of a communication device for removably securing the antenna to the communication device in accordance with the present invention is shown generally as 10. The antenna portion is shown generally as 12 and includes an antenna element 14 mounted within a flexible antenna casing 16. Also included is a conductive circular base member 18, a portion of which is connected to a proximal end 20 of the antenna casing 16 and extends therefrom. The base member 18 attaches to the antenna casing 16 by means well known in the art and is fixed relative to the casing and does not rotate relative thereto.

The base member includes an integrally formed elongated male portion 22 oppositely disposed the portion attached to the antenna casing 16. The base member 18 may be an SMB type connector. The antenna element 14 housed within the antenna casing 16 makes direct electrical contact with a center portion 26 of the elongated male portion 22 via a wire or other suitable connection means (not shown) to provide a connection between the antenna and an RF coupling 28 that is removeably attachable to the elongated male portion 22. Both the base member 18 and the RF coupling 28 may be an SMB type connector, as in well known in the art.

The RF coupling 28, has an elongated female portion 30 which electrically and mechanically mates with the male portion 22 of the base member 18 to couple RF energy from the antenna 12, through the base member and its center portion 26, and into the RF coupling 28 for distribution through wires 32 or other means as is well known in the art. In one embodiment, the RF coupling 28 may be an SMB type connector which is well known in the art, however, any suitable connector may be used.

An annular groove 34 recessed in the elongated male portion 22 of the base member 18 and disposed about midway along the length of the elongated male portion, mates with corresponding gripping means 36 disposed within the elongated female portion 30 of the RF coupling 28, as is well known in the art. When engaged, the male portion 22 of the base member 18 and the female portion 30 of the RF coupling 28 form a snap-fit mechanical and electrical connection that resists axial displacement of each part relative to the other.

The base member 18 includes an annular channel 38 recessed into a portion of the base member that is disposed between the elongated male portion 22 and the antenna casing 16. The annular channel 38 forms two shoulders 40 wherein a non-contiguous locking band 42, dimensionally appropriate to be received by the annular channel, snap-fits over the annular channel and is held in place between the oppositely disposed shoulders 40. The locking band 42 is locked in position between the shoulders 40 to prevent axial displacement of the base member 18 relative to the locking band.

The locking band 42, in the illustrated embodiment, is "C" shaped forming a non-contiguous spring-like band having a gap. The continuous radial arc of the illustrated locking band 42 is greater than 180 degrees but less than 360 degrees. When the locking band 42 is snap-fit into the annular channel 38, spring tension of the locking bound 42 biases the locking band into the annular channel with sufficient force to hold the locking band firmly in place while also allowing the locking band to frictionally rotate relative to the annular channel and hence, the base member 18. The depth of the annular channel 38 is slightly less than the thickness of the locking band such that the diameter of the locking band 42 when snapped over the annular channel is slightly greater than the diameter of the base member 18 at its widest portion, i.e. shoulders 40. Additionally, since the locking band 42 in the illustrated embodiment is not a continuous closed segment, opposing ends 43 and 44 of the locking band do not meet. Rather, one end 44 of the two opposing ends 43 and 44 of the band 42 is upturned orthogonally from a point on its circumference forming a radially projecting tongue 45. However, it is contemplated that in an alternate embodiment, the opposing ends 43 and 44 of the locking band 42 may meet while sill performing the same function.

Referring now to FIG. 1B, the tongue 45 projects radially from a center axis of the locking band 42 but additionally, has a curved portion 46 at the tip of the tongue. The curved portion 46 increases the effective thickness of the locking band 42 as will be discussed below.

Referring now to FIGS. 1A–4, one embodiment of a communication device cover 48 is shown, to which the circular base member 18, and therefore, the antenna 12 is attached. The cover 48 has a generally planar base 50 and several wall structures 52. The device cover 48 may be molded from high-impact plastic, for example, or metal, or any suitable material having appropriate strength and weight characteristics. A molded housing 54 located on one corner of the device cover 48 provides a tubular aperture 56 having a throughbore 58 which is generally circular in shape. The diameter of the throughbore 58 is sufficient to slidably receive the circular base member 18 and locking band 42 as hereinafter described.

Figure 3:
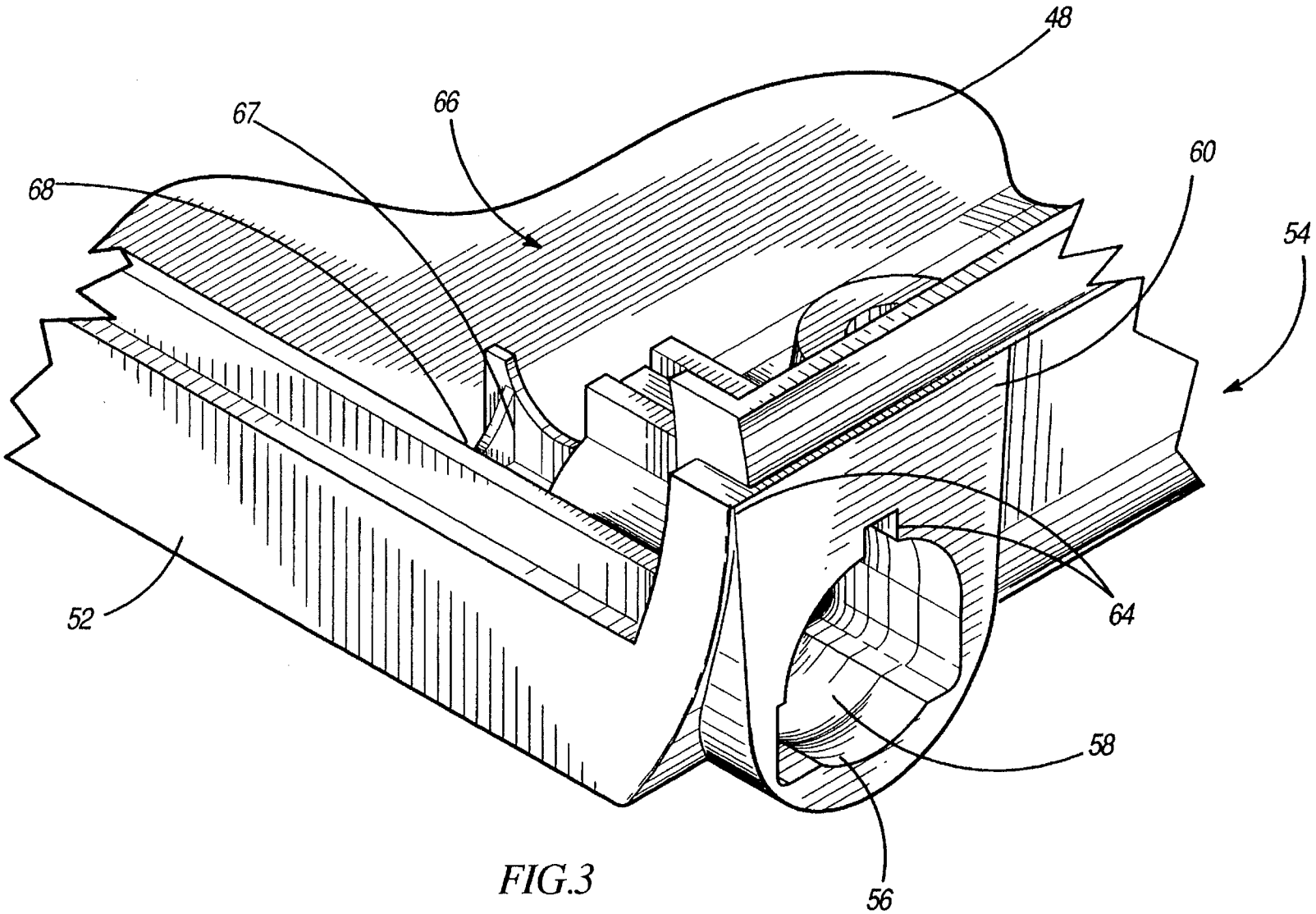
FIG. 3 depicts an enlarged view of a specific embodiment of a housing as shown in FIG. 2 taken along the arrow labeled "A".
Figure 4:
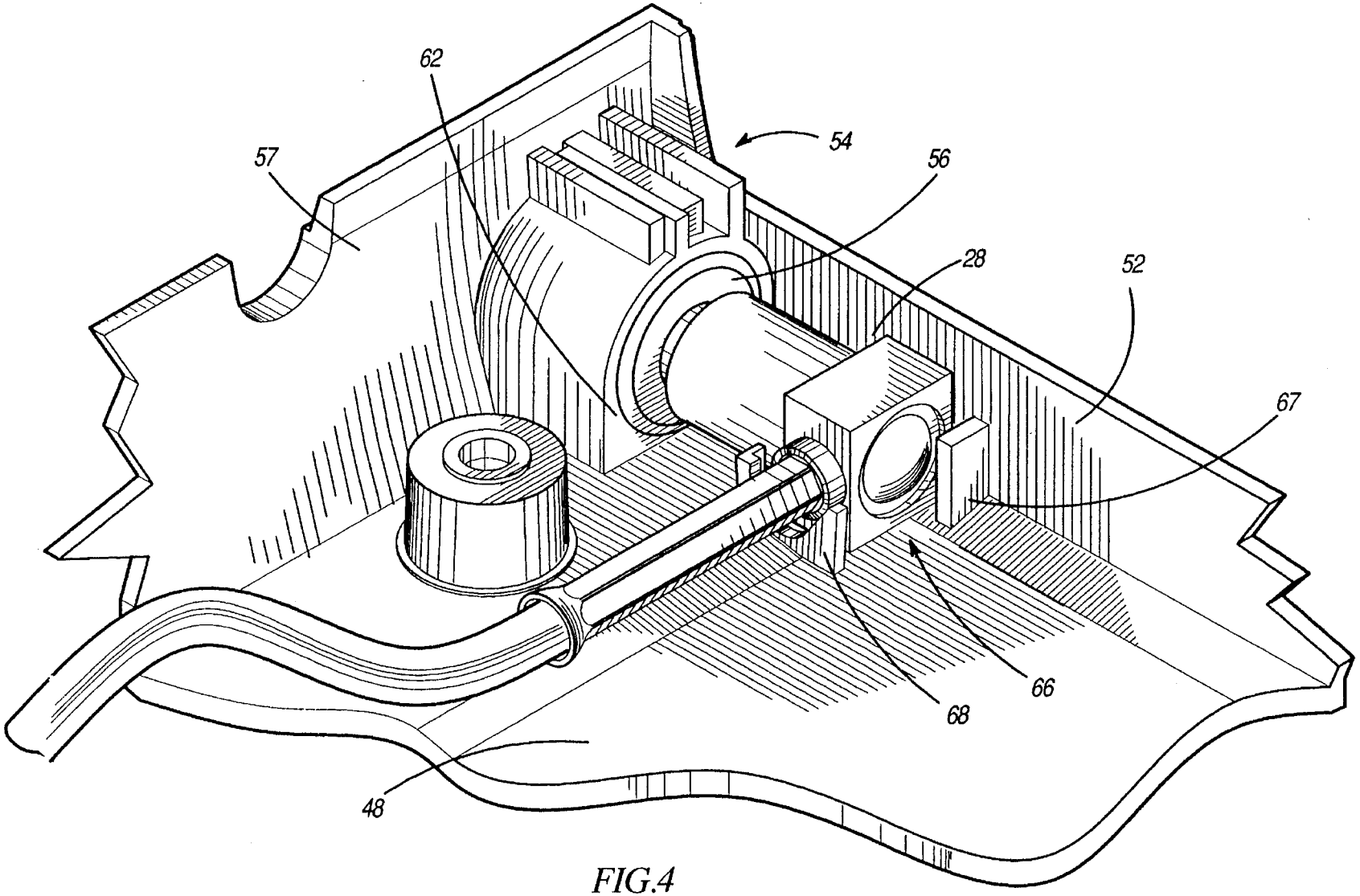
FIG. 4 depicts an enlarged view of a specific embodiment of a housing as shown in FIG. 2 taken along the arrow labeled "B".

The housing 54 includes an outside face 60 and an inside face 62 which are substantially parallel and separated by the throughbore 58. A locking slot 64 recessed into the inside surface of the throughbore 58 extends axially from the outside face 60 toward the inside face 62. As shown in FIG. 3, the locking slot 64 begins at the outside face 60 of the housing. In one embodiment, the locking slot does not continue through the entire length of the throughbore 58, but rather, only extends from the outside face 60 partially through the throughbore. In another embodiment, as shown in FIG. 4, the inside face 62 is unbroken by the locking slot 64, thus, the locking slot does not extend all the way through the length of the throughbore 58 to the inside face.

As the circular base member 18 and locking band 42 are inserted into the throughbore 58, the tongue 45 engages the locking slot 64. The width of the locking slot 64 is dimensional appropriate to receive the tongue 45 and the curved portion 46 of the tongue such that a snug fit is achieved. Due to manufacturing constraints, the locking slot 64 cannot be easily formed if it is too narrow, such as having a width equal to the radial thickness of the locking band. Thus, the locking slot 64 is formed having a convenient thickness while the curved portion 46 of the tongue 45 is imparted with a partial diameter which is approximately equal to the width of the locking slot.

Once the circular base 18 and locking band 42 are fully inserted into the housing 54, friction present between the throughbore 58 and the base member 18 and locking band 42, and between the locking slot 64 and the tongue 45, resists axial displacement of the base member and locking band. In an above-described embodiment, the locking slot 64 does not fully extend through the entire throughbore 58, thus, the tongue 45 contacts the end of the locking slot to provide a stop against which the tongue and locking band 42, and hence, the retained base member 18, rest. Accordingly, the base member 18 cannot be inserted into the housing 54 deeper than is allowed by the locking slot 64 relative to the tongue 45. In another above-described embodiment, the locking slot fully extends through the entire length of the throughbore 58. In this situation, a shoulder 65 on the antenna casing 16 contacts the outside face 64 of the housing 54 when the circular base member 18 and locking band 42 are fully inserted into the housing.

Since the tongue 45 is radially locked into the locking slot 64, the locking band cannot rotate relative to the housing 54, and remains fixed. However, the base member 18 may rotate relative to the housing 54 since the locking band 42 is free to rotate about the base member 18 with the spring tension of the locking band 42 providing resistance to rotation. Thus, the antenna 12 can frictionally rotate while the base member remains axially restrained within the housing 54 while retaining electrical and mechanical integrity with the RF connector 28. Additionally, the locking band 42 remains stationary relative to the housing while the base member rotates within, and continued rotation of the antenna 12 does not cause any wear or abrasion to the housing. Thus, rotational friction is maintained over time and continuous use.

A coupling mounting bracket 66 formed in the device cover 48 provides fixed support for the RF coupling 28. When mounted, the RF coupling 28 is in coaxial alignment with the throughbore 58 and is configured to mate with the male portion 22 and center portion 26 of the base member 18 extending through the throughbore 58, as is well known in the art. The mounting bracket 66 includes upstanding formations 67 and 68 which prevent movement of the RF coupling 28 relative to the housing, 54. Thus, with the RF coupling 28 mounted, the base member 18 inserted through the throughbore 58 contacts and mates with the RF coupling. Since the RF coupling 28 is fixed, the additional gripping force between the female portion 30 of the RF coupling 28 and the male portion 22 of the base member 18 further resists axial displacement of the base member, and hence, the antenna 12.

The above-described gripping action in cooperation with resistance to displacement created by the tongue 45 and the locking slot 64, provide a snap-fit mechanical connection between the antenna 12 and the RF coupling 28. The antenna 12 may be removed from the housing 54 by applying moderate axial force in a direction away from the housing throughbore 58. Once removed, the antenna 12 may be serviced or replaced. Although moderate force is required to remove the antenna 12, removal may be accomplished easily by hand pressure, without the need for any tools. The retaining force holding the antenna 12 in place is sufficient such that the antenna will not become accidently dislodged through rough use and handling.

A specific embodiment of the mounting assembly to attach an RF antenna to a housing of a communication device according to the present invention has been described for the purpose of illustrating the manner in which the invention may be made and used. It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

What is claimed is:

1. A mounting assembly for attaching a radio frequency antenna to a housing of a communication device for removably securing the antenna to the communication device, the assembly comprising:

a substantially circular base member extending from the antenna;

a mounting structure in the housing defining a generally tubular shaped opening;

the opening having a substantially circular cross-section for removably receiving the substantially circular base member and having an outside face, an inside face, and a recessed locking slot extending from the outside face towards the inside face;

a non-contiguous locking band coaxially surrounding a portion of the substantially circular base member for providing slidably frictional rotation of the base member within the locking band and configured to axially retain the circular base member within the locking band;

the locking band having a radially projecting tongue adapted to engage the locking slot to prevent rotation of the locking band relative to the housing while permitting rotation of the circular base member, the locking band adapted to resist axial displacement of the base member relative to the housing; and a coupler mechanism connected to a portion of the circular base member adapted to couple the circular base member to an RF coupling.

2. The mounting assembly according to claim 1 wherein the circular base member further includes an annular channel forming first and second shoulders for engaging the locking band to prevent axial displacement of the circular base member relative to the locking band.

3. The mounting assembly according to claim 1 wherein a locking channel extends between outside and inside faces of the housing.

4. The mounting assembly according to claim 1 wherein the coupler mechanism further includes gripping means adapted to further resist axial displacement of the base member relative to the housing.

5. The mounting assembly according to claim 1 wherein the locking band slidably permits three-hundred and sixty degree continuous rotation of the circular base member relative to the locking band and relative to the housing.

6. The mounting assembly according to claim 1 wherein the tongue further includes a curved portion, the diameter of which facilitates removable engagement of the locking band within the locking slot.

7. The mounting assembly according to claim 1 wherein the coupler mechanism facilitates the transmission of radio frequency energy from the antenna to the communication device.

8. The mounting assembly according to claim 1 wherein the coupler mechanism is further adapted to resist axial displacement of the base member relative to the housing.

9. A mounting assembly for attaching a radio frequency antenna to a housing of a communication device, the assembly comprising:

a clip for removably securing the radio frequency antenna to the housing, the clip including a circular body formed of a relatively thin radial thickness and having a constant axial length, the circular body forming a continuous radial arc of more than 180 degrees and less than 360 degrees with opposing ends of the arc defining a first and a second end;

a locking formation disposed on the first end and extending along a radial plane relative to the circular body;

a substantially circular base member extending from the antenna;

a mounting structure in the housing defining a generally tubular shaped opening;

the opening having a substantially circular cross-section for removably receiving the substantially circular base member and having an outside face, an inside face, and a recessed locking slot extending from the outside face towards the inside face;

the locking formation adapted to engage the locking slot to prevent rotation of the clip relative to the housing while permitting rotation of the circular base member, the clip adapted to resist axial displacement of the base member relative to the housing; and a coupler mechanism connected to a portion of the circular base member adapted to couple the circular base member to an RF coupling.

10. The mounting assembly according to claim 9 wherein the circular base member further includes an annular channel forming first and second shoulders for engaging the clip to prevent axial displacement of the circular base member relative to the clip.

11. The mounting assembly according to claim 9 wherein a locking channel extends between outside and inside faces of the housing.

12. The mounting assembly according to claim 9 wherein the coupler mechanism further includes gripping means adapted to further resist axial displacement of the base member relative to the housing.

13. The mounting assembly according to claim 9 wherein the clip slidably permits three-hundred and sixty degree continuous rotation of the circular base member relative to the clip and relative to the housing.

14. The mounting assembly according to claim 9 wherein the locking formation includes a curved portion, the diameter of which facilitates removable engagement between the locking formation and the locking slot.

15. The mounting assembly according to claim 9 wherein the coupler mechanism facilitates the transmission of radio frequency energy from the antenna to the communication device.

16. The mounting assembly according to claim 9 wherein the coupler is further adapted to resist axial displacement of the base member relative to the housing.

* * * * *